United States Patent [19]

Thomson

[11] 3,939,989

[45] Feb. 24, 1976

[54] COUPLING APPARATUS

[75] Inventor: William H. Thomson, Nice, Calif.

[73] Assignee: The Raymond Lee Organization, Inc., a part interest

[22] Filed: Dec. 13, 1974

[21] Appl. No.: 532,371

[52] U.S. Cl. ..... 213/75 TC
[51] Int. Cl.[2] ..... B61G 1/00
[58] Field of Search ..... 213/75 TC, 75 R, 124, 134

[56] References Cited

UNITED STATES PATENTS

| | | | |
|---|---|---|---|
| 1,054,298 | 2/1913 | Lennon | 213/134 |
| 2,872,051 | 2/1959 | Dunbar | 213/75 TC |
| 3,140,784 | 7/1964 | Goldbeck et al. | 213/75 TC |

*Primary Examiner*—M. H. Wood, Jr.
*Assistant Examiner*—Gene A. Church

[57] ABSTRACT

Apparatus used for coupling and decoupling of model railroad cars which employs first and second coupling units, one on each car. Each unit employs a horizontal member having a curved opening at one end and a latching means which can be disposed either into the opening or outside of it and can be pivoted into either position. Each unit further employs a locking element having normal locked position at which the latching means can be moved into or out of the opening. A tiltable control lever extends through the member and has means cooperating with the locking element for unlocking same. The units are moved toward each other to couple and are moved away from each other to uncouple. When the units are coupled, the latching means engage each other and are disposed within the corresponding openings.

4 Claims, 7 Drawing Figures

FIG.1
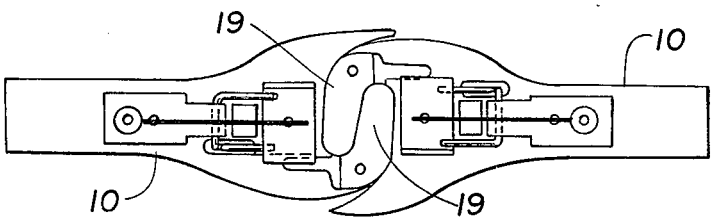
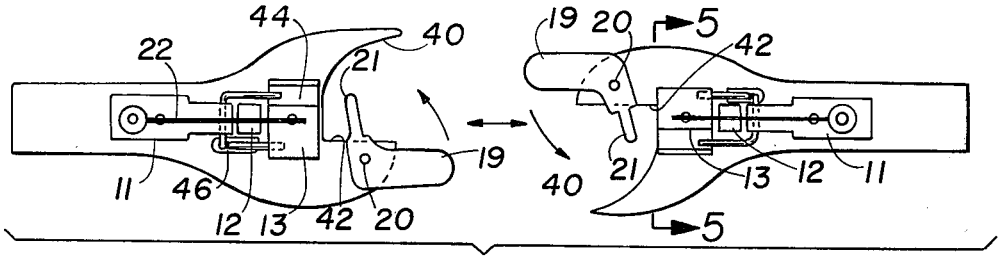
FIG.2
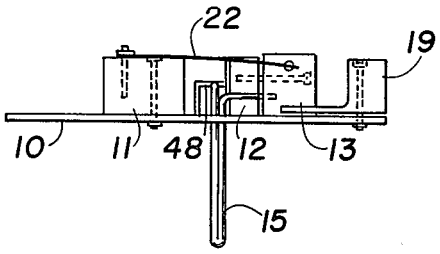
FIG.3
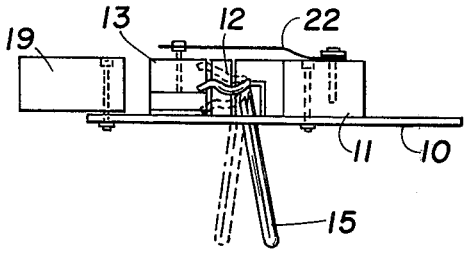
FIG.4
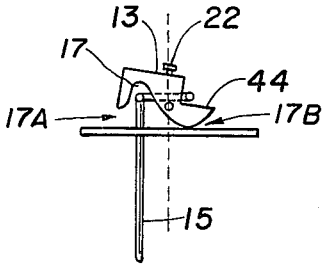
FIG.5
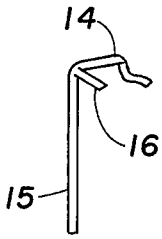
FIG.6
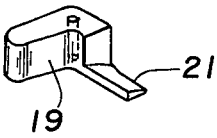
FIG.7

COUPLING APPARATUS

SUMMARY OF THE INVENTION

This invention is directed toward apparatus which is particularly adaptable for use in coupling and decoupling cars used on model railroads. The apparatus employs two coupling units, one on each car, which can be readily coupled together or can be equally readily decoupled.

Each unit employs a horizontal member having a curved opening at one end. Latching means is pivotally disposed on the member and can be pivoted either into or out of the opening. A locking element on the member has a normal locked position at which the latching means is locked into the opening. The element has an unlocked position at which the latching means can be pivoted out of the opening. A tiltable control lever extends through an opening in the member and has means cooperating with the element.

With the elements unlocked, the members are pushed toward each other into coupling position wherein the latching means engage each other and are disposed within the corresponding openings. The elements are then locked.

The levers can be operated manually or by remote control as desired, and can be actuated either by a cam rising out of the road-bed or by a small electromagnetic in the road-bed.

BRIEF DESCRIPTION OF THE DRAWINGS

In the drawings:

FIG. 1 is a top plan view of a pair of coupling units in locked position;

FIG. 2 is a similar view but showing the units unlocked;

FIG. 3 is a side elevation view of the left hand coupling in locked position;

FIG. 4 is a side elevation view of the right hand coupling in unlocked position;

FIG. 5 is a view taken along line 5—5 in FIG. 3;

FIG. 6 is a perspective view of a pendulum type locking and trigger release element; and FIG. 7 is a perspective view of a locking element.

DETAILED DESCRIPTION OF PREFERRED EMBODIMENT

Referring now to FIGS. 1–7, each of the two coupling units has a plate 10 with a suitably curved opening 40 at one end. These openings 40 face each other. Each of the end supporting openings have a horizontal face 42. A separate locking element is secured pivotally to each plate 10 adjacent each face by pivot pin 20, the element having a locking shoe 19 and bevel arm 21.

Bearing blocks 11 are secured to plates 10 adjacent opposite smaller ends. Smaller blocks 12 are likewise secured adjacent blocks 11 and serve as mounts for lock and release elements 13. Each element 13 has a channel or recess 17 disposed thereunder as well as a lowered horizontal extension 44. Plates 10 having horizontally elongated openings 46 adjacent blocks 11 and 12 through which trip levers 15 extend essentially vertically. At the top end of each lever is a horizontal L shaped extension 14 which extends along a recess 48 in each block 11 and then alongside block 12 over surface 44. Horizontal extension 16 disposed at the top of each lever extends along the opposite side of block 12 into recess 17. The walls of the recess are relatively short and do not extend downward to plate 10.

When lever 15 is tilted as shown in FIG. 4, the element 13 is tilted and arm 21 of the appropriate locking element is free to swing thereunder. The tilt can be in either direction.

Spring 22 secured at one end to block 11 bears at the other end downwardly against element 13 thus biasing it into locked position and preventing movement of arm 21. The tilting action overcomes the bias and holds element 13 in unloaded position.

In use, the levers are tilted and plates 10 are either pushed together for engagement of the units or pulled apart for disengagement. In either case, the shoes 19, guided by the curved openings 40, swing into the position shown.

The tiltable control lever is not in contact with the locking device except when passing over an electromagnet in the road-bed or a cam rising out of the road-bed or other means which causes the levers in the units to be moved as follows.

When two cars coupled together are pushed over the means in the road-bed, the lever in the first car will be moved in a direction away from the first car and the lever in the second car will be moved in a direction toward the second car. However the locking element 13 in both cars assume the same position as shown in FIG. 5. Since the pressure point of spring 22 is past top dead center, the springs hold the elements in this position. After the levers have passed the means in the road bed, they are free to swing back out of contact with surfaces 44 and recesses 17.

When the cars are pulled apart as on a side track, the locking elements are free to open, arms 21 passing through point 17A and then under point 17B. This lifts the locking elements into the original position and springs 22 will return past dead center and lock the elements in position.

Subsequently when two cars are brought together with each coupling unit in open position, the arms will move through points 17B and 17A, becoming locked behind the vertical side under point 17A. This vertical side and the flat side of arm 21 are then in contact.

Lever 15 is shown as a doubled wire but can be formed differently as desired.

Thus cars can be uncoupled at any point with using as few as one road-bed means and without the necessity of touching the cars or couplings by hand.

Plate 10, in the finished product, can take the form of the bottom of the coupler with sides and cover to conceal the working parts and provide further support for the pivot pin 20. This establishes a more realistic appearance to the couplers and enables the "curved opening" in the "plate" to have a realistic shape.

While the invention has been described with detailed reference to the drawings, the protection sought is to be limited only by the terms of the claims which follow.

I claim:

1. Coupling apparatus comprising:

first and second horizontally elongated members having adjacent ends which can be moved toward or away from each other into or out of coupling position, said ends having curved openings;

first and second latching means, each latching means being pivotally secured to an adjacent end of a corresponding member, each latching means being disposed in the curved opening of its member and engaging the other latching means when the members are coupled, said latching means being disposed outside of the curved openings when the members are uncoupled;

first and second locking elements, each element being disposed on a corresponding member adjacent the latching means, each element being normally in a first position at which the corresponding latching means is locked in position within the corresponding opening, each element having a second position at which the corresponding latching means is unlocked and is free to be moved out of the opening; and first and second tiltable control levers having positions extending downward through openings in the members, said levers when inclined in either direction causing said elements to be placed in the second position whereby the members can be moved out of coupling position and the elements returned to the first position, each lever having means cooperating with the corresponding element to produce the desired action.

2. Apparatus of claim 1 further including third and fourth means each disposed on a corresponding member to maintain the corresponding element in the first position until the corresponding lever is tilted.

3. Apparatus of claim 2 wherein each locking means can be tilted from a first horizontal locking position into the second position.

4. Apparatus of claim 3 wherein the levers can be tilted in either direction while remaining in a vertical plane.

* * * * *